US006025108A

United States Patent [19]

Hujii et al.

[11] Patent Number: 6,025,108

[45] Date of Patent: Feb. 15, 2000

[54] NON-MAGNETIC CONTACTING ONE COMPONENT-TYPE DEVELOPMENT SYSTEM

[75] Inventors: Atsushi Hujii; Nariaki Tanaka, both of Osaka; Hideki Taniguchi, Nakatsu, all of Japan

[73] Assignee: Mita Industrial Co., Ltd., Japan

[21] Appl. No.: 09/176,627

[22] Filed: Oct. 22, 1998

[30] Foreign Application Priority Data

Oct. 31, 1997 [JP] Japan ..... 9-301015
Oct. 31, 1997 [JP] Japan ..... 9-301016

[51] Int. Cl.[7] ..... G03G 13/08

[52] U.S. Cl. ..... 430/111; 430/120

[58] Field of Search ..... 430/106, 109, 430/120, 111

[56] References Cited

U.S. PATENT DOCUMENTS 4,984,326 1/1991 Horie et al. ..... 15/256.5
5,328,792 7/1994 Shigemori et al. ..... 430/106.6
5,712,072 1/1998 Inaba et al. ..... 430/110

*Primary Examiner*—John Goodrow
*Attorney, Agent, or Firm*—Fulbright & Jaworski L.L.P.

[57] ABSTRACT

The developing process of this invention comprises supplying a charged toner to a development roller disposed against a photosensitive drum, forming a thin layer of the charged toner on the development roller by a blade press-contacted with the development roller, and contacting this thin layer of the charged toner on the surface of the photosensitive drum on which an electrostatic latent image is formed. The process further comprises using a non-magnetic toner which has a circularity degree of more than 0.94 and which has a falling amount of at least 10 g/5 minutes as measured by a tester for measuring the amount of falling. By using such a toner, it is possible to prevent the collection of the toner on the bottom of a development housing which includes various members for practicing the above process, and it is also possible to prevent the rising of a driving torque of the rollers. The development process of this invention is particularly effectively applied to laser prints or facsimiles containing an ultra-small sized development unit.

6 Claims, 5 Drawing Sheets

NON-MAGNETIC CONTACTING ONE COMPONENT-TYPE DEVELOPMENT SYSTEM

BACKGROUND OF THE INVENTION

1. Field of the Invention

This invention relates to a so-called non-magnetic contacting one component-type development system which comprises supplying a non-magnetic toner to a development roller via a sub-roller and contacting the toner supplied to the development roller with the surface of a photosensitive drum on which an electrostatic latent image is formed to perform development of the electrostatic latent image.

2. Description of the Prior Art

In the formation of an image in an electrophotographic method, an electrostatic latent image is formed in a photosensitive drum, the electrostatic latent image is developed with a toner to form a visual image, the toner image is transferred to a transfer paper, and then fixing this image.

The development methods used in this electrophotography include a two-component type magnetic development method using a mixture of a toner and a magnetic carrier, a one component type magnetic development method using a one component type toner containing a magnetic powder, and a non-magnetic contacting one component type development method using a non-magnetic one component-type toner. In view of the cost of a developer, the miniaturization and cost of a development machine, and the simplicity of the operation, the non-magnetic contacting one component type development method is the best.

The desire to super-miniaturize an apparatus for non-magnetic contacting one component type developing system is great, and in order to meet this requirement, the photosensitive drum together with the development roller and the toner-supplying sub-roller should be miniaturized, and these machines should be contacted with each other. For this purpose, the driving motor and the driving power source should naturally be miniaturized. Rotating directions of the devlopment roller and the sub-roller and rotating directions of the development roller and the photosensitive drum should be prescribed so that the driving torques will be decreased.

Japanese Laid-Open Patent Publication No. 197710/1997 discloses a development apparatus comprising a latent image-forming member (photosensitive drum), a toner layer-carrier (development roller) which carries the toner layer on the surface and develops the latent image formed on the latent image-forming member by press-contacting with the above latent image-forming member and rotating, a toner supplying member (sub-roller) for supplying the toner to this toner layer-carrier, and a supplying auxiliary member contacting the supplying member, or arranged in the vicinity of the toner suppying member. This Patent Publication also describes a method of development by using a non-magnetic one component toner which is obtained by a pulverization and has an average circularity degree (C) of not larger than 0.94. The average circularity degree (C) is calculated by the following formula:

$$C=A/AL$$

wherein A is the area of the projected image of the toner, and AL is the area of a circle having the same circumferential length as that of the toner projected image.

However, when an irregularly shaped non-magnetic one component-type toner obtained by this pulverization method is applied to the above super-miniaturized non-magnetic contacting one component-type development system, at the time of supplying the toner from the sub-roller to the development roller, a part of the toner not supplied to the development roller tends to collect successively in the bottom of the development housing. In such a super-miniaturized development unit, the space between the bottom of the development housing and the sub-roller is very narrow, and the collected toner reaches a nipping position between the development roll and the sub-roller. For this reason, the torque (to be referred to as a development torque) becomes very large, and finally the driving gear becomes locked.

In the non-magnetic contacting one component-type development system, the thickness of the layer of the one component-type toner supplied to the development roller is made thin by a blade (toner thin layer forming blade), and the development is carried out by contacting this thin toner layer with the photosensitive drum. As this blade, a metallic conductor such as SUS is used in order to apply voltage to impart a charge to the toner.

However, when development is carried out by using the toner thin layer forming blade composed of such a metallic conductor, as the development is repeated, the toner adheres to the blade. A thin layer of the toner is not formed on a portion of the development roller corresponding to the blade portion to which the toner adheres, and black striae or white striae occur in the resulting image. This tendency is especially marked when the development is carried out at a high temperature and under high humidity. When the development apparatus or a toner obtained by the pulverization method is used, it is impossible to settle this problem.

SUMMARY OF THE INVENTION

An object of this invention is to provide a development method in a non-magnetic contacting one component-type development system, in which a required development torque can be markedly lowered and collection of the toner in the bottom of the development housing can be prevented.

Another object of this invention is to provide a method of development in which poor imaging such as black striae or white striae, which occur as a result of not forming a thin layer of the toner on a development roller uniformly, can be prevented.

A yet another object of this invention is to provide a toner used in the above development method.

According to this invention, there is provided a method of development which comprises using a non-magnetic toner having a circularity degree of larger than 0.94 and the amount of falling, as measured by a tester for the amount of falling, being at least 10 g/5 minutes, supplying the above toner onto a development roller disposed opposite to a photosensitive drum via a sub-roller, forming a thin layer of the toner by means of a blade pressure-contacted with the development roller, and contacting the thin layer of the toner with the surface of the photosensitive drum on which an electrostatic latent image is formed, thereby to perform development.

In such a present invention, to decrease the development torque, the rotating directions of the development roller and the sub-roller should be prescribed in a downward direction in a portion where both rollers face each other. Furthermore, the rotating directions of the development roller and the photosensitive drum are prescribed in an upward direction in a portion where both rollers face each other. The peripheral speed of the sub-roller should be prescribed preferably as the 1.05 to 3.1 times the peripheral speed of the development roller.

In this invention, as the blade for forming a thin layer of the toner on the development roller, it is most preferable to use a blade having a silicone rubber pressing member at its forward end in order to form a thin layer of the toner uniformly over a long period of time stably.

DETAILED DESCRIPTION OF THE INVENTION

In the present invention, circularity (C) is A/AL, wherein A represents the area of the projected image of the toner and AL represents the area of a circle having the same circumferential length as the circumferential length (L) of the projected image.

The amount of toner-falling which is determined by a tester means the flowability of toner and it is measured by the following method.

(Measurement of the amount of toner-falling)

Figure 1:
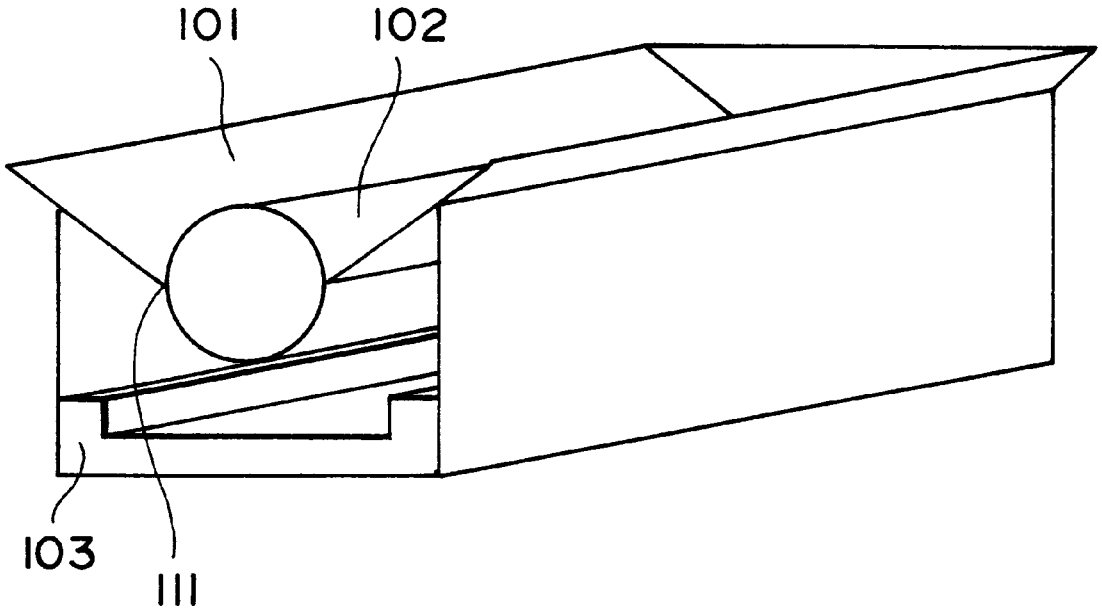
FIG. 1 is a view showing the structure of a tester for measuring the amount of falling of the toner.

Thirty grams of an electrophotographic toner is put into a 300 ml cylindrical container with a clousure. It is stirred about thirty times in an inverted manner upwardly and downwardly. Then, the flowability is measured by using the tester shown in FIG. 1.

This tester has a hopper 101 on which a sample toner is carried, a toner supplying roller 102 arranged in an opening 111 at the bottom of the hopper 101, and a receiving dish 103 provided below the supplying roller 102. The toner supplying roller 102 is a metallic cylinder having a diameter of 16 mm and a length of 94 mm and having convex and concave parts (knurling cuts) on the surface. By rotating, the sample toner is fallen from the hopper 101 to the receiving dish 103. A predetermined amount of the electrophotographic toner is carried on the hopper 101, the toner supplying roller 102 was rotated at a fixed speed, and the amount of the toner which is fallen into the receiving dish within a fixed period of time is measured to evaluate the flowability of the toner.

The convex and concave parts formed on the surface of the toner supplying roller 102 are knuring cuts defined by JIS B0951 having a double-cut module (m) of 0.2 (pitch= 0.628 mm, r=0.06 mm, h=0.132 mm). The rotating speed of the toner supplying roller 102 is prescribed as 5 rotations per minute, and the falling amount of the toner to the receiving dish 103 within 5 minutes is measured.

Figure 2:
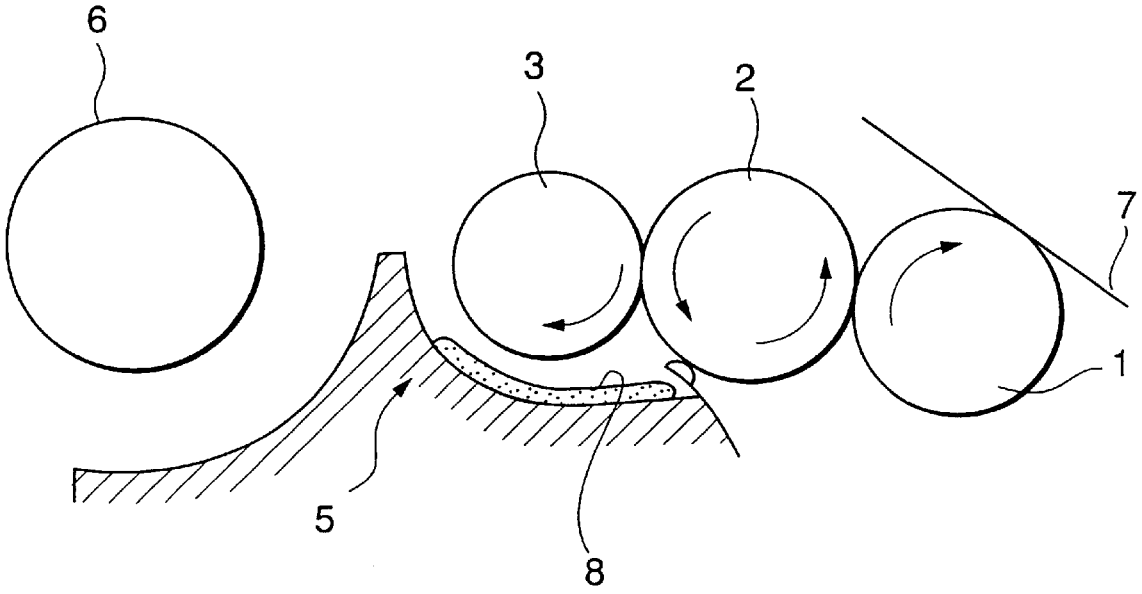
FIG. 2 is an explanatory view for explaining a theory of this invention.

In FIG. 2 showing the view of the essential portion of non-magnetic contacting one component type developing system, this developing system is composed of a small-diameter photosensitive drum 1 which forms an electrostatic latent image, a small-diameter development roller 2 which carries a charged toner layer and contacts a photosensitive drum 1, and a sub-roller 3 which contacts the development roller 2 and supplies a toner to the development roller 2. A blade 4 which regulates the thickness of the toner layer on the development roller and serves to charge the toner is provided below the development roller 2 in a manner to contact the development roller 2. The bottom 5 of the development housing is positioned below the sub-roller 3 with a small distance. In the interior of the development housing, a stirring paddle 6 for stirring the one-component type toner is provided in close vicinity to the sub-roller 3.

A tranfer paper 7 is supplied to the upper portion of the photosensitive drum 1 in a condition of one pass face down, and the toner image is transferred to the transfer paper. As already pointed out, the sub-roller 3 and the development roller 2, and the development roller 2 and the photosensitive drum 1 are contacted each other at a trail (same direction at the contacting portion). Since the transfer paper is supplied as mentioned above, the photosensitive drum 1 rotates in a clockwise direction, the development roller 2 in a counter-clockwise direction, and the sub-roller 3 in a clockwise direction in FIG. 2.

For this reason, the rotating directions of the development roller 2 and the sub-roller 3 become a trail in a donward direction and thus, the toner collects between the sub-roller 3 and the bottom 5 of the development housing. This increases the torque of the toner and becomes a cause of locking of the driving gear.

In the non-magnetic contacting one component-type development system of the present invention, a toner having the above circularity degree of more than 0.94 and having the amount of falling, measured by the above tester, of at least 10 g/5 minutes is used. In this case also, the toner 8 is dropped between the sub-roller 3 and the bottom 5 of the development housing and gradually collects there. However, since the toner has a very good flowability, the toner successively dropped extrudes the toner, which collects at the bottom, smoothly to an action position of the stirring paddle 6.

For this reason, a toner exceeding a certain fixed amount does not collect below the development roller 2 and the sub-roller 3, the toner which has dropped without being supplied to the development roller 2, is again circulated to the sub-roller 3 via the stirring paddle 6, and becomes helpful for supplying the toner.

Table 1 of the Example to be given below shows the relation among the circularity degree of the toner or the amount of falling and the occurrence of locking of driving gear. It is clear that when both of the circularity degree and the amount of falling satisfy the conditions of the present invention, the occurrence of the locking of the driving gear can be avoided.

In the non-magnetic contacting one component-type development system of the present invention, the peripheral speed ratio of the sub-roller 3 to the peripheral speed of the development roller 2 is preferably 1.05 to 3.1. This is preferable that a high density image can be formed without the occurrence of image fogging.

When this peripheral speed ratio is lower than the above range, the density of an image is liable to be decreased by the shortage of supplying the toner. On the other hand, if the peripheral speed ratio exceeds the above range, image fogging is liable to be increased by the excessive supply of the toner.

Table 2 of the Example mentioned below shows this relation.

Thus, according to this invention, in a small sized non-magnetic contacting one component-type development system, a torque generated between the development roller and the sub-roller and between the development roller and the photosensitive drum can be made very small, and together with the above fact, it is possible to make a driving motor or a driving power source small-sized. In addition, since the toner in a development apparatus can be uniformly stirred, and the toner is uniformly consumed, it is advantageous that the toner can be effectively utilized, and flowability of the toner can be ensured throughout the life of the toner.

Furthermore, according to the present invention, because the toner having a circularity degree (C) of more than 0.94 is used, by providing a silicone-rubber pressing member at a tip of a blade for forming a toner thin layer, this pressing member wears away moderately as the development is repeated. As a result, the adhesion of the toner to the pressing member can be effectively prevented, and when the development is repeated a number of times, a thin layer of the toner can be formed uniformly on the development roller, and poor images such as white striae or black striae are effectively prevented.

Figure 3A:
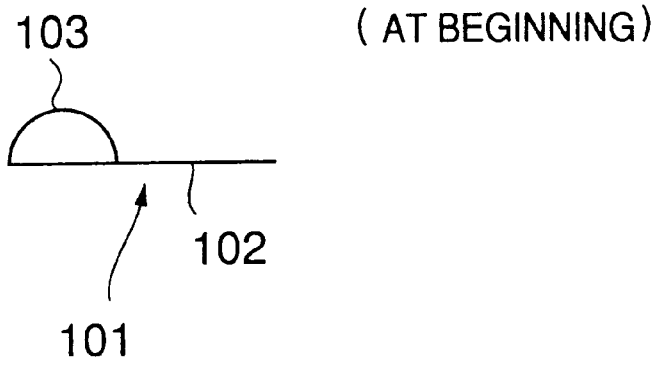
FIG. 3 is a view for explaining the theory of shaving off the forward end of the blade for forming a thin layer of the toner (B) in FIG. 3 differs from toner (A) in FIG. 3.
Figure 3B:
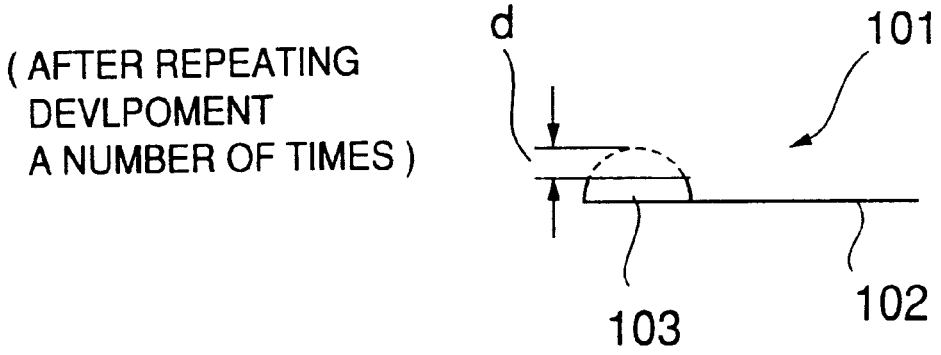

In FIG. 3 for explaining the wear of the pressing member at the tip of a blade, this toner thin layer-forming blade 101 is composed of a metallic plate 102 having an action of a pressing spring, and a silicone-rubber pressing member 103 provided at the tip of the metallic plate 102. This pressing member 103 has a semi-circular shape in section in the early period (A) shown in FIG. 3 and has a height of 1.2 to 3.0 mm.

The silicone rubber of the pressing member 103 may have a hardness (JIS K 6301 (A)) of 75 to 85 degrees. If the hardness is lower than the above value, the deformation owing to wearing become large, and it becomes difficult to form a correct toner thin layer. On the other hand, if the hardness exceeds the above range, the amount of shredding is too small and black striae or white striae occur due to adhesion of the toner (see Table 4 of the Example).

It is understood that the pressing member 103 at the tip of the blade, after the repeating of the development a number of times, decreases the height by the shredded amount (d), and the semi-circular structure of the pressing member 103 is deformed due to wearing (see (B) of FIG. 3).

In Table 3 of the Example to be described below, with respect to a blade in which the pressing member 103 is composed of a silicone rubber having a hardness of 80 degrees, the relation between the circularity degree (C) of the toner and the shredded amount d (mm) after running 3000 sheets is shown. It is understood from Table 3 that when the toner having a circularity (C) degree of more than 0.94 is used, the shredded amount of the blade is decreased and such circularity (C) is critical in maintaining the amount in a proper range.

It was explained that the pressing member made of a silicone rubber at the tip of the toner thin layer-forming blade is semi-circular. But the shape is not limited to semi-circular, and may be any desired curved structure in section such as a semi-elliptic, parabolic, or hyperbolic form.

[Toner]

Toners used in this invention have a circularity degree of more than 0.94, especially at least 0.95 and a fallen amount of at least 10 g/5 minutes, especially 10.0 to 14.0 g/5 minutes. These toners are different from irregularly shaped toners obtained by a pulverization method, but are suitable as a spherical toner produced by a polymerization method, or by converting the irregularly-shaped toner.

This spherical toner contains a fixing resin component, a coloring agent, a high molecular weight or a low molecular weight charge controlling agent, and a releasing agent. Preferably, this toner is composed of a mono-dispersed particler or a particle near the above particle which has a median diameter of 10 to 30 $\mu$m, especially 5 to 25 $\mu$m, and a dispersion degree of a particle diameter of D25/D75 of 2.0 or below, especially 1.8 or below. In the present specification, D25 and D75 represent 25% and 75% of a particle diameter of a volume integration of the entire toner particles.

The polymerization method spherical toner can be obtained by suspension-polymerizing a toner-forming composition containing at least a radical polymerization initiator, a vinyl-type monomer capable of becoming a fixing resin and a coloring agent in an aqueous medium.

So long as the circularity degree is within the above range, a spherical toner by another method may of course be used. For example, an irregularly toner obtained by kneading, pulverizing and classifying a toner-forming resin composition is melted in a hot air, and the resulting toner is made spherical. Thus obtained toner can be used in the present invention. Furthermore, a molten product of a toner-forming resin composition is sprayed into a hot atmosphere and the sprayed toner product is granulated into a spherical toner. This toner can be used in this invention, too.

Preferred polymerization method toners will be explained below.

The vinyl-type monomer capable of forming a fixing resin is water-insoluble. This monomer can form a thermoplastic resin having fixability and electroscopic property. Suitable examples of this monomer are not limited to the following compounds, but include vinyl aromatic monomers, acrylic monomers, vinyl ester monomers, diolefin monomers, and monoolefin monomers.

The vinyl aromatic monomers may include vinyl aromatic hydrocarbons of the following formula (1)

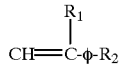

(1)

wherein $R_1$ represents a hydrogen atom, a lower alkyl group or a halogen atom, $R_2$ represents a hydrogen atom, a lower alkyl group, a halogen atom, an alkoxy group, a nitro group or a vinyl group, and $\phi$ is a phenylene group.

Specific examples include styrene, $\alpha$-methylstyrene, vinyltoluene, $\alpha$-chlorostyrene, o-, m-, p-chlorostyrene, p-ethylstyrene and divinylbenzene and mixtures of at least two of the above monomers.

The acrylic monomers may include acrylic monomers having the following formula (2)

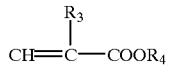

(2)

wherein $R_3$ represents a hydrogen atom or a lower alkyl group, and $R_4$ represents a hydrogen atom, a hydrocarbon group having up to 12 carbon atoms, a hydroxyalkyl group or a vinyl ester group.

Examples of such acrylic monomers include methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, $\beta$-hydroxy ethyl acrylate, γ-hydroxy propyl acrylate, δ-hydroxy butyl acrylate, β-hydroxy ethyl methacrylate, ethylene glycol dimethacrylate and tetra ethylene glycol dimethacrylate.

Other monomers include vinyl esters such as vinyl formate, vinyl acetate and vinyl propionate; vinyl ethers such as vinyl n-butyl ether, vinyl phenyl ether and vinyl cyclohexyl ether; diolefins such as butadiene, isoprene and chloroprene; and monoolefins such as ethylene, propylene, isobutylene, butene-1 and pentene-1,4-methylpentene-1.

Preferred monomers are the styrene monomers, the acrylic monomers and the styrene-acrylic monomers.

Inorganic and organic pigments and dyestuffs are used as coloring agents for toners. The preferred coloring agents are as follows. The coloring agents may be used in an amount of 3 to 20% by weight based on the resin in the toners.

Black pigments

Carbon black, acetylene black, lamp black and aniline black.

Yellow pigments

Chrome yellow, zinc yellow, cadmium yellow, yellow iron oxide, Mineral Fast Yellow, nickel titanium yellow, Naples Yellow, Naphthol Yellow S, Hansa Yellow G, Hansa Yellow 10G, Benzidine Yellow G, Benzidine Yellow GR, quinoline yellow lake, permanent yellow NCG and Tartazine Lake.

Orange pigments

Chromine orange, molybdenum orange, permanent orange GTR, Pyrazolone Orange, Vulcan Orange, Indanthrene Brilliant Orange RK, Benzidine Orange G, and Indanthrene Brilliant Orange GK.

Red Pigments

Red iron oxide, cadmium red, red lead, cadmium mercury sulfide, Permanent Red 4R, Lithol Red, Pyrazolone Red, Watchung Red Calcium Salt, Lake Red D, Brilliant Carmine 6B, eosine lake, Rhodamine Lake B, Alizalin Lake and Brilliant Carmine 3B.

Violet pigments

Manganese violet, Fast Violet B, and methyl violet lake.

Blue pigments

Prussian Blue, cobalt blue, alkali blue lake, Victoria Blue Lake, phthalocyanine blue, non-metallic phthalocyanine blue, phthalocyanine blue partially chlorinated product, Fast Sky Blue, and Indanthrene Blue BC.

Green pigments

Chrome green, chromium oxide, Pigment Green B, Malachite Green Lake, and Fanal Yellow Green G.

White pigments

Zinc flower, titanium oxide, antimony white and zinc sulfide.

Extender pigments

Baryta, barium carbonate, clay, silica, white carbon, talc, and alumina white.

As radical polymerization initiators, known radical polymerization initiators such as azo compounds, hydroperoxide-type compounds, peroxide-type compounds, peracid type initiators, or redox type initiators may be used. Suitable examples are not limited to the below-mentioned compounds, but include 2,2'-azobisisobutyronitrile, 2,2'-azobis(2,4-dimethylvaleronitrile), 2,2'-azobis(2-cyclopropylpropionitrile), 2,2'-azobis(4-methoxy-2,4-dimethylvaleronitrile), 1,1'-azobis(1-cyclohexanecarbonitrile), benzoyl peroxide and (1-phenylethyl)azodiphenylmethane.

A known toner aid may be incorporated in a toner-forming composition for forming a spherical toner. This aid is, for example, a charge controlling agent or a releasing agent.

As the releasing agent, various waxes, polypropylene waxes, polyethylene waxes, and acid-modified products of the above waxes may be exemplified. These releasing agents may be included in the toner-forming composition in emulsion particle sizes.

As the charge controlling agents, oil-soluble dyes such as nigrosine base (CI 504), oil black (CI 26150) and spiron black, metal naphthenates, metal soaps of fatty acids and metal-containing complex salt dyes. Charge controlling functional group-containing water-soluble monomers which can copolymerize with the above-vinyl type monomers can also be used. Examples of such monomers include radical-polymerizable monomers having an electrolytic group, for example, a sulfonic acid type-, a phosphoric type- or a carboxylic acid type anionic group and a cationic group such as a primary-, secondary-, tertiary-amino group or a quaternary ammonium group. Suitable examples include styrenesulfonic acid, sodium styrenesulfonate, 2-acrylamide2-methylpropanesulfonic acid, 2-acid phosphoxypropyl methacrylate, 2-acid phosphoxyethyl methacrylate, 3-chloro-2-acid phosphoxypropyl methacrylate, acrylic acid, methacrylic acid, fumaric acid, crotonic acid, tetrahydroterephthalic acid, itaconic acid, aminostyrene, aminoethyl methacrylate, aminopropyl acrylate, diethylaminopropyl acrylate, γ-N-(N',N'-diethylaminoethyl)aminopropyl methacrylate, and trimethyl ammonium propyl methacrylate.

Further, by using a radical initiator containing an electrolytic group, for example, a sulfonic acid type-, a phosphoric acid type- or a carboxylic acid type anionic group, and a cationic group such as a primary-, secondary- or tertiary-amino group, or a quarternary ammonium group a charge controlling group may be introduced in to the end of a polymer.

In the production of a polymerization method toner, a toner-forming composition containing a vinyl type monomer is suspended in water. In this case, the concentration of the composition may be 1 to 50% by weight, especially 5 to 30% by weight. A suitable size of suspended particles is adjusted to generally 1 to 30 μm, especially 5 to 25 μm.

As required, a dispersion stabilizer may be used to stabilize the condition of suspension of the toner-forming composition. Examples of such a dispersion stabilizer include polymers soluble in an aqueous medium such as polyvinyl alcohol, methyl cellulose, ethyl cellulose, polyacrylic acid, polyacrylamide, polyethylene oxide, poly (hydroxystearic acid-g-methyl methacrylate-CO-methacrylic acid) copolymer, or inorganic powders such as nonionic or ionic surface active agent, or calcium phosphate. It is preferred to add the dispersion stabilizer in an amount of 0.1 to 10% by weight, especially 0.5 to 5% by weight, in the system.

The amount of the initiator in the toner-forming composition may preferably be 0.3 to 30% by weight, especially 0.5 to 10% by weight based on the monomer.

In performing the polymerization, the atmosphere of the reaction system is substituted by an inert gas such as nitrogen, and while the aforementioned suspended state is maintained, the polymerization is carried out at a temperature of 40 to 100° C., especially 50 to 90° C. Of course, mild stirring can be carried out to homogenize the reaction system.

Since the polymerization product after the reaction can be obtained in the form of a granular product having the aforesaid particle size range, the produced particles are filtered, as required washed with a suitable solvent, and dried to form toner particles.

To increase the flowabillity of the toner particles, it is effective to add a flowability improving agent (surface treating agent) to the toner particles. The toner particles are sprinkled with the flowability improving agent (surface treating agent) such as carbon black, hydrophobic amorphous silica, hydrophobic fine alumina, finely divided titanium oxide and fine spherical resins to give a final toner. The flowability improving agent (surface treating agent) may be used in an amount of 0.1 to 3.0% by weight based on the toner.

To improve the flowability, heat resistance and offset resistance property of the polymerization method toner, the average molecular weight of the toner should generally be 10,000 to 150,000, desirably 10,000 to 100,000.

In the toner of this invention, the fallen amount mentioned above depends on the circularity degree or the particle diameter of the toner particle, and also it depends on the treatment of the flowability improving agent (surface treating agent) or the charged amount by the compounding of a charge controlling agent. In short, by changing the amount of compounding or the type of the flowability improving agent, the fallen amount is adjusted to the range defined in this invention.

[Non-magnetic contacting one component type developing system]

Figures 4A, 4B:
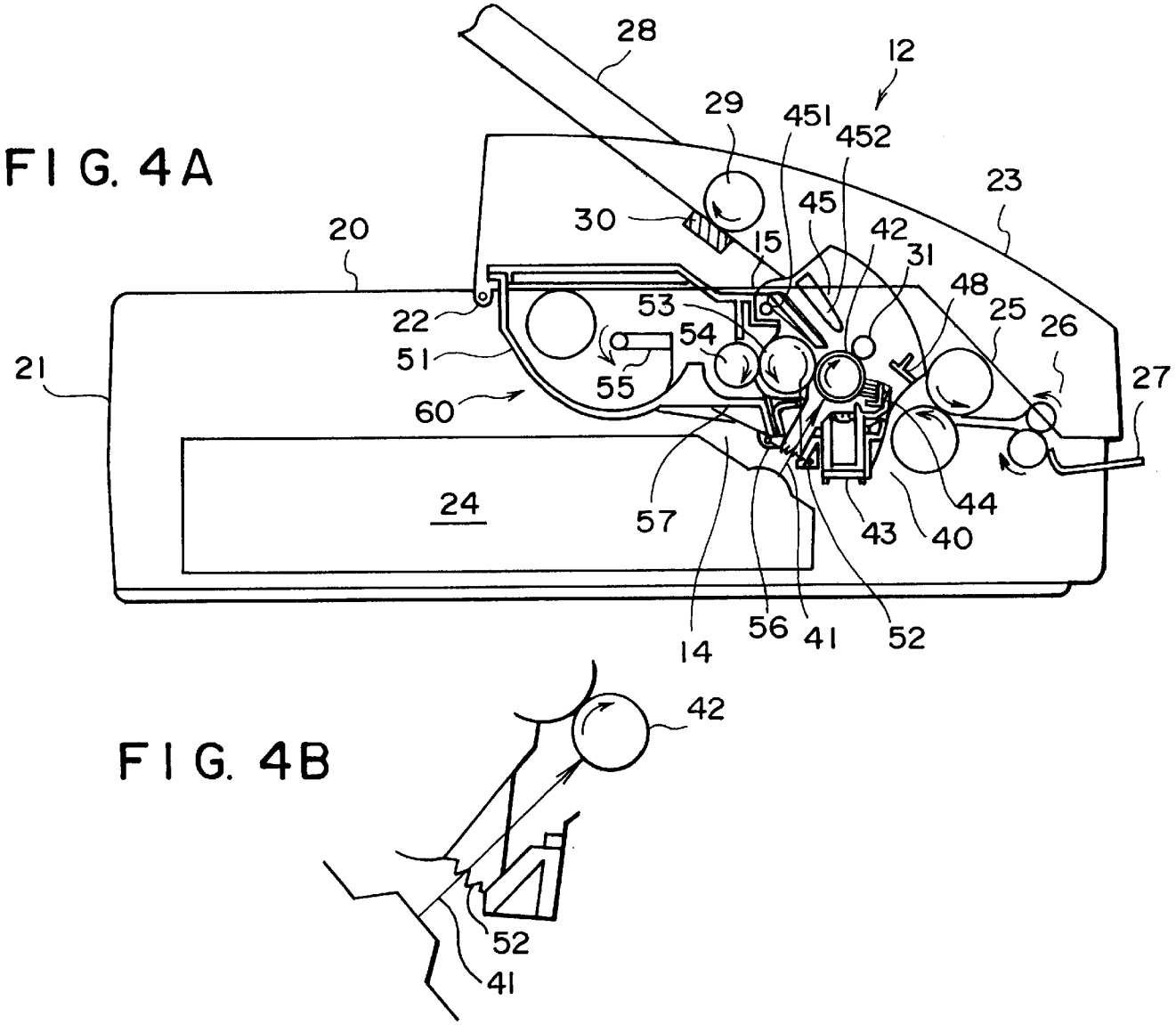
FIG. 4 is one example of an image forming apparatus using a development system of this invention in which (A) in FIG. 4 shows a side arrangement of the entire apparatus and (B) in FIG. 4 shows an enlarged view of the vicinity of an exposure passage of the apparatus.

In FIG. 4 in which the non-magnetic contacting one component type developing system of this invention is applied to a printer 12, the printed 12 is provided with a machine housing 20 and includes a box-like main body 21 opened in at least the forward upper portion and a cover 23 mounted rotatably to an axis 22 at the upper portion of the main body 21. A process unit 14 is arranged in the inside portion of the machine housing 20.

The process unit 14 is composed of a photosensitive unit 40 and a development unit 50, and the development unit 50 is rotatably provided in the photosensitive unit 40 via a supporting axis 15.

The photosensitive unit 40 rotatably supports a photosensitive drum 42 and is provided with a charging mechanism 43 and a foreign matter recovering brush 44 around the photosensitive drum 42.

The development unit 50 has a development housing 51 and is provided with a development roller 53 accommodated in the housing and a sub-roller 54 for supplying a toner which contacts the development roller 53. Below the development roller 53, a blade 56, which contacts the development roller 53, controls the thickness of the toner layer on the development roller 53 and serves to charge the toner, is provided. Below the sub-roller 54, a bottom 57 of the development housing 51 is present at a small distance. In the inside portion of the development housing 51, a stirring paddle 55 for stirring the one component type toner is provided in close vicinity to the sub-roller 54.

A tensile spring 52 is provided between the photosensitive unit 40 and the development unit 50, and the development roller 53 is press-contacted with the photosensitive drum 42. In this press-contacted state, obliquely downwardly of the photosensitive drum 42, a passage 41 for image exposure is formed.

In the inside portion of the main body 21 of the machine housing 20, a laser unit 24 is accommodated, and a laser light outputted from the unit 24 is introduced to photosensitive drum 42 through the passage 41 for image exposure.

The inside portion of the machine housing 20 is provided with a paper supply tray 28 and a discharge paper tray 27. Between these trays, a pre-transfer guide plate 45, transfer roller 31 approaching the photosensitive drum, an after-transfer guide plate 46, a fixing roller 25 and a discharge roller 26 in this sequence are provided. At a forward end of the paper supply tray 28, a paper supply roller 29 and a friction pad 30 which are driven at the time of printing are provided so that one paper will be delivered.

An upper portion 452 of the pre-transfer guide plate 45, the transfer roller 31, an upper portion of the after-transfer guide plate 46, an upper portion of the fixing roller 25, and an upper portion of the discharge roller 26 are provided in a cover 23. On the other hand, the lower 451 of the pre-transfer guide plate 45, the lower portion of the after-transfer guide plate 46, the lower portion of the fixing roller 25 and the lower portion of the discharge roller 26 are provided in the main body 21, and when the cover 23 is opened, the transfer paper passage is all opened whereby paper jamming can be easily removed.

The photosensitive drum 42 has an electrophotographic photosensitive layer formed on an electroconductive metal drum. From the viewpoint of economy, it should be preferably be an organic photosensitive drum. Furthermore, from the viewpoint of preventing the generation of ozone, it should desirably be a positive chargeable photosensitive material.

As the organic photosensitive material, a mono-dispersed type photosensitive material having a charge transporting agent (especially a combination of a hole transporting agent and an electron transporting agent) and a charge generating agent in a resin medium, or a laminated type photosensitive material composed of a charge transporting layer containing a charge transporting agent and a charge generating layer containing a charge generating agent. In this laminated type photosensitive material, the charge generating layer (CGL) and the charge transporting layer (CTL) may be laminated in this sequence or in an inverse order.

Examples of the charge generating agent include selenium, selenium-tellurium, amorphous silicon, pyrylium salt, azo pigments, disazo pigments, anthanthrone pigments, phthalocyanine pigments, indigo pigments, threne pigments, toluidine pigments, pyrazoline pigments, perylene pigments and quinacridone pigments. One or at least two of them may be used as mixtures so that an absorption wavelength region is present in a desired region.

Various resins may be used as a resin medium for dispersing a charge generating agent. Examples of this medium may include olefinic polymers such as styrene polymer, acrylic polymer, styrene-acrylic polymer, ethylene/vinyl acetate copolymer, polypropylene and ionomers, polyvinyl chloride, vinyl chloride/vinyl acetate copolymer, polyester, alkyd resin, polyamide, polyurethane, epoxy resin, polycarbonate, polyarylate, polysulfone, diallyl phthalate, silicone resin, ketone resin, polyvinyl butyral resin, polyether resin, phenolic resin, and photocurable resin such as epoxy acrylate resin. These binder resins may be used singly or as mixtures of two or more resins. Preferred resins may include styrene polymer, acrylic polymer, styrene-acrylic polymer, polyester, alkyd resin, polycarbonate, and polyarylate.

The charge transporting agents may be used as a known electron transporting or hole transporting agent, singly or a mixtures of at least two agents. Example of the hole transporting agents include poly-N-vinylcarbazole, phenanthrene, N-ethylcarbazole, 2,5-diphenyl-1,3,4-oxadiazole, 2,5-bis-(4-diethylaminophenyl)-1,3,4-oxadiazole, bis-diethylaminophenyl-1,3,4-oxadiazole, 4,4'-bis(diethylamino)-2,2'-dimethyltriphenylmethane, 2,4,5-triaminophenylimidazole, 2,5-bis(4-diethylaminophenyl)-1,3,4-triazole, 1-phenyl-3-(4-diethylaminostyryl)-5-(4-diethylaminophenyl)-2-pyrazoline, p-diethylaminobenzoaldehyde-(diphenylhydrazone), tetra (m-methylphenyl)meta-phenylenediamine and N, N, N',N'-tetraphenylbenzidine derivatives. The electron transporting agents include 2-nitro-9-fluorenone, 2,7-dinitro-9-fluorenone, 2,4,7-trinitro-9-fluorenone, 2,4,5,7-tetranitro-9-fluorenone, 2-nitrobenzothiophene, 2,4,8-trinitrothioxanthone, dinitro-anthracene, dinitroacridine, dinitroanthraquinone, 3,5-dimethyl- 3',5'-ditertiarybutyl-diphenoquinone, and naphthoquinone derivatives.

In the mono-dispersed photosensitive material, the charge generating agent (CGM) may be contained in an amount of 1 to 7% by weight, especially 2 to 5% by weight, per solid component in the photosensitive material. Furthermore, the charge transporting agent (CTM) may be contained in an amount of 20 to 70% by weight, especially 25 to 60% by weight per solid component in the photosensitive material.

From the standpoint of high sensitivity and the broadness of uses which makes reversal development possible, electron transporting agents (ET) are preferably used in combination with the hole transporting agent (HT). It is most preferred to use ET and HT in a weight ratio of 10:1 to 1:10, especially 1:5 to 1:2.

Generally, in the case of small sized printers or facsimiles, the photosensitive drum has a diameter of about 10 to 60 mm, and the photosensitive layer has a thickness of about 10 to 40 Mm.

As the charging mechanism, a corona charger such as a corotron or a scorotron may be used. For the purpose of stabilizing the charging of the photosensitive layer uniformly, a scorotron charger, which is provided with a corona wire, a shield and a grid set in an opening portion of the photosensitive material side of the shield, is suitable. In the apparatus of FIG. 3, the charging mechanism 43 is provided below the photosensitive drum 42 and is arranged so that the effect of a discharged product on the photosensitive material is minimized.

Generally, charging is preferably carried out so that the saturated charged potential of the photosensitive material is adjusted to the range of 500 to 2000 volts.

The development roller 53 and the sub-roller 54 used in this image forming system are composed of an electric conductor elastic body (rubber) roller. This elastic body roller may be obtained by compounding an electric conductor powder such as an electric conductive carbon black or a metal powder in an elastomer polymer such as urethane rubber or a silicon rubber and molding the resulting composition into a roller.

The development roller 53 and the sub-roller 54 may preferably have a volume resistivity of generally $10^4$ to $10^9$ Ω.cm. If the volume resistivity is higher than the above range, it is difficult to apply a bias voltage. If the volume resistivity is lower than the above range, a leakage tends to occur by discharging on the surface of the photosensitive material.

Furthermore, the development roller 53 preferably has a hardness (Ascar C hardness) of 60 to 85. If the hardness is higher than the above range, the toner layer is difficult to contact uniformly the surface of the photosensitive material, or abrasion tends to occur in the photosensitive material. On the other hand, if the hardness is lower than the above range, a sufficient press-contacting force is difficult to transmit through the roller, and the development roller 53 tends to wear down.

The development roller 53 has a surface roughness, determined by a 10-point average roughness RZ defined by JIS B 0601, of 5.0 to 12.0, preferably from the viewpoint of toner-carrying property and developing property.

As the sub-roller 54, an electric elastic body as in the same way as in the development 53 may be used. However, this sub-roller 54 has preferably a considerably smaller hardness than the development roller 53. Generally, it suitably has an Ascar F hardness of 75 to 95.

The stirring paddle 55 gives a stirring action to one-component toner accommodated in the development housing, and supplies the one-component toner to the sub-roller 54. It is composed of a stirring frame provided on a rotation axis and a flexible sheet provided at the forward end of this frame. A number of holes are provided in the frame and the sheet so that the degree of stirring is adjusted not to be excessive. The flexible sheet may be formed from a flexible film such as a PET film so that the sheet can be curved by elasticity. By this flexible sheet, one-component toner is pressed against the sub-roller 54 so that the supplying of the one-component toner to the sub-roller 54 is carried out smoothly.

A bias voltage enabling a reversal development is applied to the development roller 53. This bias voltage has the same polarity as the charged potential of an unexposed portion of the photosensitive material, and as an absolute value, may be higher than the potential of an exposed portion, and may be lower than the potential of the unexposed portion in order to make the reversal development possible. On the other hand, it is preferable to apply a bias voltage having a high absolute value and the same polarity as the development bias voltage to the sub-roller 54 to smoothen the supply of the one-component toner to the development roller 53. Generally, it may be preferable to apply a voltage which is higher than the development bias voltage by 0 to 600 volts as an absolute value.

The rotating directions of the sub-roller 54 and the development roller 53, as shown in FIG. 4, are downwardly directed (in a forward direction) at a contacting portion; on the other hand, the rotating directions of the development roller 53 and the photosensitive drum 42 are an upwardly directed (in a forward direction) at a contacting portion. The peripheral speed ratio of the sub-roller 54/the development roller 53 is suitably in the range of 1.05 to 3.1, and on the other hand, the peripheral speed ratio of the development roller 53/the photosensitive drum 42 is suitably 1.2 to 3. If the peripheral speed ratio is smaller than the above range, the supply of the one-component toner becomes insufficient. When the peripheral speed ratio is larger than the above range, these rollers or the drum tends to be worn in a greater degree.

The transfer roller 31 is to apply a transfer voltage from the back of the transfer paper in a non-contacted state with the photosensitive drum 42, and an electric conductive rubber roller may be used. This electric conductive rubber roller is the same as the development roller but preferably has an Ascar C hardness of 50 to 80.

Figure 5:
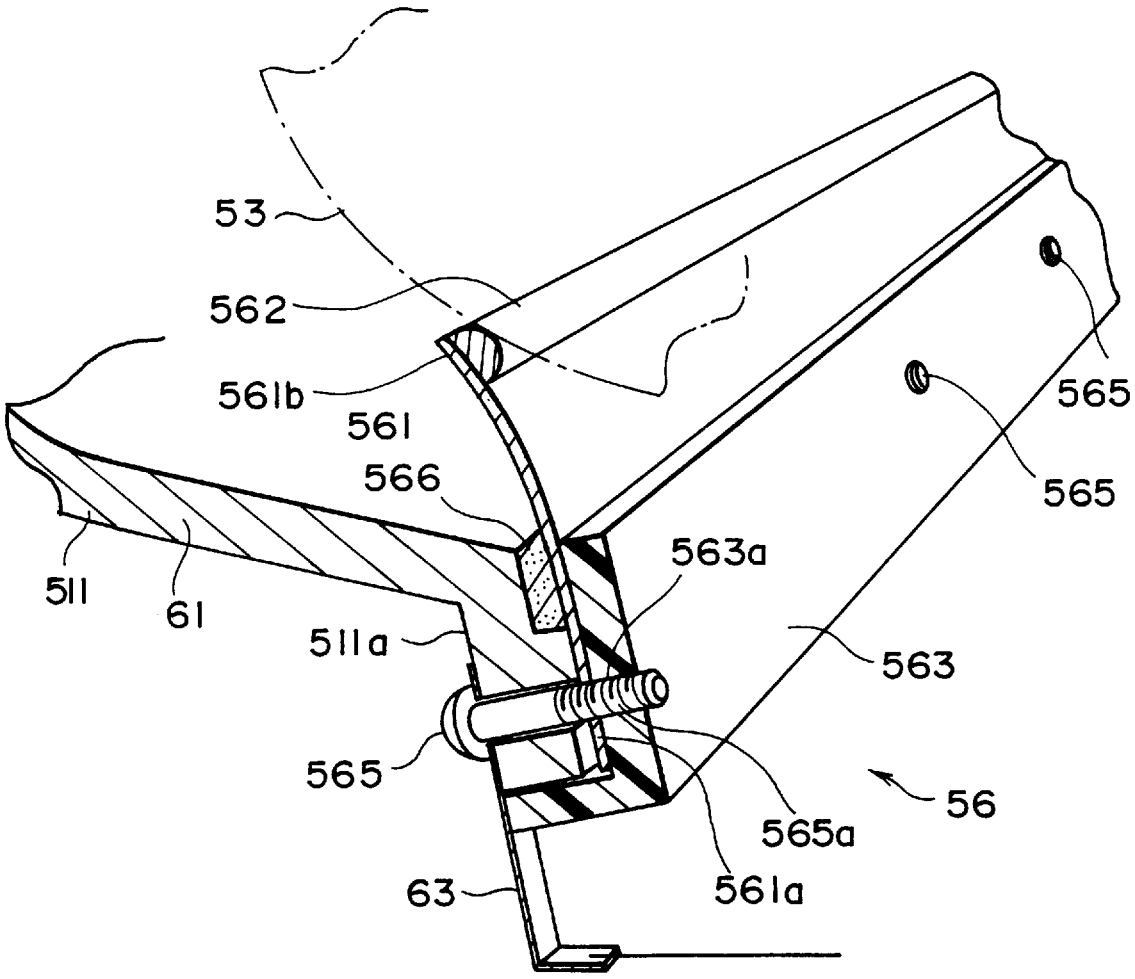
FIG. 5 is a perspective view showing a blade for forming a thin film of the toner used in the apparatus of FIG. 4 in a large scale.

In FIG. 5 showing the detailed structure of the thin-layer forming blade 56, the blade 56 is provided with a metallic plate spring 561. This plate spring 561 may be a thin flat steel sheet having flexibility and elasticity, for example a stainless steel sheet or a spring steel sheet having a thickness of about 0.1 to 0.2 mm. It may have a nearly same longitudinal size as the length of the development roller 53.

A pressing member 562 composed of a silicone rubber is mounted, for example by an adhesive agent, on the surface (the side facing the development roller 32) of the forward end 561*b* of the plate spring 561.

The root 561*a* of the plate spring 561 is aided and installed by a pressing plate 563 to a blade securing portion 511*a* provided in an opening end on the side of a photosensitive unit 40 of a bottom 511 of a development housing 51.

The blade securing portion 511*a,* the root 561 of the plate spring 561 and the pressing plate 563 are provided with a plurality of screw-insertion holes at predermined distances in the longitudinal direction. Screws 565 are inserted to the holes and screw portions 565*a* formed at the tip portion of the screws 565 are screwed on female screws 563*a* formed in the holes, whereby the plate spring 561 is fastened and fixed. A sealing member 566 composed of a sponge material etc. is provided in a space formed between the blade securing portion 511*a* and the root 561*a* of the plate spring 561.

In this way, the pressing member 562 composed of a silicone rubber can be press-contacted with the development roller 53 always at a fixed pressing pressure.

A charge of a fixed polarity can be applied to the one-component type toner by friction between the toner and the pressing member 562 or the development roller 53.

Examples of the silicon rubber composing the pressing member include silicon rubbers containing polydimethylsiloxane, polymethylphenylsiloxane, or polydiphenylsiloxane as a constituent unit. These rubbers may be used together with rubber compounding agents, for example, reinforcing agents or fillers such as extenders (oils), carbon black or white carbon.

The hardness of the silicon rubber can be adjusted to the range defined in the range defined in this invention by controlling the compounding amount of the oil.

Image formation may be performed in the following manner in this non-magnetic one component contacting developing system.

1) Charging step: The photosensitive layer of the drum 42 rotates in an arrow direction (clockwise direction) in FIG. 4, and corona (for example, a positive corona) from the charging mechanism 43 charges the photosensitive layer uniformly. Generally, the surface potential of the photosensitive layer is prescribed as 500 to 2000V as an absolute value.

2) Image exposing step: According to printed data from a personal computer or a word processor connected to the printer 12, a laser light from a laser unit 24 is exposed to a photosensitive layer of the drum 42 to form an electrostatic latent image. By the imagewise exposure using the laser light, the potential of a portion (a portion irradiated by the laser light) corresponding to a light image of the photosensitive layer becomes 0 to 300V (absolute value) and the potential of a portion not irradiated with the laser light (background) is maintained as a dark decay potential from a main charging potential to form an electrostatic latent image.

3) Development step: One component type toner is stirred by the stirring paddle 55, and the toner is charged by friction with the stirring paddle 55 or the wall of the development housing 51. The charged one component toner is supplied to the surface of the sub-roller 54 rotating in the arrow direction (clockwise direction) in FIG. 4, supported and conveyed to the development roller 53 rotating in a counterclockwise direction, and supplied to the development roller 53. The one component type toner layer on the surface of the development roller 53 is regulated in the thickness by the blade 56, and is contacted with the photosensitive layer of the drum 42 and developed. The final charging of the toner, as already mentioned, is carried out by friction with the forward end of the pressing member at the tip of the blade and the development roller.

The one-component type toner used in this development is charged in the same polarity as the potential of the unexposed portion of the photosensitive layer. As a result, by reversal development, the toner is adhered to the laser light irradiated portion.

4) Transfer step: A transfer paper accommodated in a paper supply tray 28 is supplied in a single sheet between a transfer roller 31 and the photosensitive drum 42 by means of a paper supply roller 29 and a friction pad 30, and contacts the photosensitive drum 42 having the one-component type toner image and the toner image is transferred.

5) Fixing step: The transfer paper to which the toner image has been transferred is supplied to a pair of fixing rollers, and fixation under heating of the toner image is carried out. The transfer paper on which the toner image has been fixed is discharged on the tray 27 by means of a discharging roller 26.

6) After-treatment step: A foreign matter such as paper dust adhering to the photosensitive drum 42 is removed from the surface of the photosensitive drum by means of a foreign matter recovering brush 44. On the other hand, the toner remaining on the surface of the photosensitive drum is cleaned by contact with the development roller 53.

EXAMPLES

The present invention will be explained by the following Examples.

Example 1

Production of a toner

Toner A: Pulverized toner (no sphering treatment)

This toner contains a styrene-acrylic polymer as a binder resin. The binder resin and toner compounding agents (coloring agent and synthetic wax) were pre-mixed by using a Henschel mixer, and the mixture was biaxially extruded, and melted and kneaded by a kneader. The kneaded mixture was pulverized and classified, and as a surface treating agent, silica was outwardly added in an amount of 1% by weight to obtain a toner A. The volume average particle diameter of the present toner was ($D_{50}$) 9.0 $\mu$m (central value). The present toner had a circularity degree of 0.32, and a falling amount, determined by a tester, of 5.56 (g/5 minutes).

Toner B: polymerization method toner

The present toner is obtained by suspension-polymerizing a toner-forming composition comprising a radical polymerization initiator, a styrene monomer, an acrylic monomer, a coloring agent, and a synthetic wax in an aqueous medium, and as a surface treating agent, 0.5% by weight of silica is outwardly added and treated. The volume average particle diameter of this toner was ($D_{50}$) 9.0 $\mu$m (central value). The present toner had a circularity degree, as defined above, of 0.95 and a falling amount, as defined above using the tester, of 8.29 (g/5 minutes).

Toner C: Polymerization method toner

The added amount of the surface treating agent of the toner B was adjusted to 1.0% by weight. The toner had a circularity degree, defined above, of 0.95, and a falling amount, as defined above using a tester, of 10.2 (g/5 minutes).

Experiment showing the relation among the circularity degree or the falling amount of the toner and the driving gear LASERFAX "TC-720" made by Mita Industrial Co., Ltd. was remodeled to take the structure shown in FIG. 4, and a test was carried out using the above toners. The results were as shown in Table 1. In the case of toner A, when the number of printed sheets was about several hundred sheets (calculated as A4 sheets vertically arranged), the toner collects in the bottom of the housing corresponding to the sub-roller, and finally the driving gear was locked. In the case of toner B, the printer was driven without any problem at the beginning, but when about 1000 sheets were printed, the movement of the sub-roller and the development roller became dull, the driving gear was locked momently.

On the other hand, the flowability of the toner C in the developer was very good, and when the number of printed sheets exceeded 3000 sheets, the printers were driven in a condition having no problem. This is probably because a toner having a suitable circularity and a suitable falling amount was used.

Experiment showing the relation between the peripheral speed ratio of the sub-roller to the development roller and a printed image The "TC-720 remodeled" used in the above experiment was further remodeled so that the motor was outwardly secured to the printer so as to change the peripheral speed of the sub-roller to the development roller. At a peripheral speed ratio shown in Table 2, 3000 sheet continuous prints (calculated as A4 vertical) were obtained. The first print, and one sample from each 500th sheet were taken out as 7 sample sheets in total. In these samples, by using a reflection densitomer (type number TC-6D made by Tokyo Denshoku Sha), the image density (ID) of an output imaged and the fog density (FD) of a blank portion were measured, and average values are shown in Table 2. As a result, if the peripheral speed ratio is as small as 1.0, the amount of the toner supplied to the development roller is insufficient, and there can only be obtained a print having a low image density below ID=1.330 defined as an ordinary image density. Inversely, when the peripheral speed ratio is as high as 3.5, the amount of the toner to the development roller becomes excessive so that an image having a fog density FD of greater than 0.005 which is regarded as having no problem is formed. It can be understood that the peripheral speed ratio should be defined as 1.05 to 3.1.

TABLE 1

Relation between the circurality degree or the falling amount of the toner and the driving gear

| Circularity degree | Falling amount (g/5 minutes) | Judgement |
|---|---|---|
| 0.32 | 5.56 | Bad: At about several hundred sheets, the driving gear is locked. |
| 0.95 | 8.29 | Bad: At about 1000 sheets, the driving gear is locked. |
| 0.95 | 10.2 | Good: Since the toner more than a fixed amount did not collect, the driving gear was not locked. |

TABLE 2

Relation between the peripheral speed ratio of the sub-roller to the development roller and the inconvenience of the image

| Peripheral speed ratio | Amount of the toner supplied to the development roller | ID | FD | Judgement of the image |
|---|---|---|---|---|
| 1.0 | Insufficient | 1.251 | 0.001 | Bad: insufficient image concentration |
| 1.05 | Moderate | 1.386 | 0.001 | Good: Image density, image fogging at a level without any problem. |

TABLE 2-continued

Relation between the peripheral speed ratio of the sub-roller to the development roller and the inconvenience of the image

| Peripheral speed ratio | Amount of the toner supplied to the development roller | ID | FD | Judgement of the image |
|---|---|---|---|---|
| 2.5 | Moderate | 1.402 | 0.002 | Good; Image density, image fogging at a level without any problem. |
| 3.1 | Moderate | 1.423 | 0.003 | Good; Image density, image fogging at a level without any problem. |
| 3.5 | Excessive | 1.440 | 0.009 | Bad: Image fogging increased |

Note) 3000 continuous printed sheets were produced, the first printed sheet and one sample sheet was taken at each 500th sheet, and a total of 7 samples were taken. By using a reflection densitometer (type TC-6D made by Tokyo Denshoku Sha), the image density (ID) of a black solid portion of an output image and the fog density (FD) of a blank portion were measured.

Example 2

Preparation of a toner

Toner D: Pulverized toner (with a sphering treatment)

The toner A prepared in Example 1 was melted and sphered in a hot air current by using a hot air treating machine to obtain a toner D. This toner D had a circularity degree of 0.75.

By using the toner A and the toner C prepared in Example 1 and using the toner D above, the following experiment was performed.

Experiment showing the relation between the circularity degree of the toner and the shredded amount of the blade By using the remodeled LASERFAX "TC-720" used in Example 1 (at the forward end of the blade, a silicone rubber pressing member having a semi-circular section and a hardness A of 80 degrees was provided), an image was formed on 3000 sheets having a size of A4. The shredded amount of the forward end of the pressing member was measured. The results are shown in Table 3.

From Table 3, the shredded amount of the blade during the use of the toner A and the toner D was 1.2 mm and 1.0 mm, respectively. The shredded amount of the blade was great, and a normal thin layer of the toner could not be formed (the thin layer became thick). The formed image had a high fogging density, and was poor in quality.

On the other hand, when the toner C was used, the blade could be shred moderately and the occurrence of the melt-adhesion of the toner was fully prevented. Moreover, the thin layer of the toner could be formed normally.

Experiment showing the relation between the hardness of the blade and the shredded amount of the blade Using the toner C in the remodeled machine of "TC-720", the hardness of the silicone rubber of the pressing member was changed to the four types shown in Table 4, and after the production of 3000 printed sheets (calculated as A4 vertically arranged), the shredded amount of the blade was measured. The results are shown in Table 4. From Table 4, when the hardness of the rubber was as low as 71 degrees, the shredded amount of the blade was too large, and it was impossible to form a thin layer of the toner normally (the thin layer was thick). The resulting image had a poor quality having a high fogging density. Conversely, when the rubber had a hardness of as high as 90 degrees, the shredded amount of the blade was too small, and in the same way as when sus, etc. was used, melt-adhesion of the toner occurred.

On the other hand, when the rubber having a hardness of 75 degrees or 85 degrees was used, the blade could be shredded moderately, and the occurrence of melt-adhesion of the toner was fully prevented. It was possible to form a thin layer of the toner normally.

The hardness of the blades used in the above experiment was based on JIS K 6301 (A type).

TABLE 3

Relation between the circularity degree of the toner and the shredded amount of the blade (after the running of 3000 sheets)

| Circularity degree | Shredded amount (mm) of the blade | Judgement |
|---|---|---|
| 0.32 | 1.2 | Bad: A normal thin layer of the toner could not be formed because the shredded amount of the blade was much (the thin layer became thick). |
| 0.75 | 1.0 | Bad: A normal thin layer of the toner could not be formed because the shredded amount of the blade was much (the thin layer became thick). |
| 0.95 | 0.5 | Good: The blade was moderately shredded, and there was no melt-adhesion of the toner. |

TABLE 4

Relation between the hardness and the shredded amount (after running 3000 sheets)

| Hardness of the blade | Shredded amount (mm) of the blade | Judgement |
|---|---|---|
| 71 | 1.1 | Bad: It was impossible to form a normal thin layer of the toner because the shredded amount of the blade was much (the thin layer became thick). |
| 75 | 0.5 | Good: The blade was moderately shredded, and there was no melt-adhesion of the toner. |
| 85 | 0.4 | Good: The blade was moderately shredded, and there was no melt-adhesion of the toner. |

TABLE 4-continued

Relation between the hardness and the shredded amount (after running 3000 sheets)

| Hardness of the blade | Shredded amount (mm) of the blade | Judgement |
|---|---|---|
| 90 | 0.1 | Bad: Since the shredded amount of the blade was small, melt-adhesion of the toner occurred. |

What is claimed is:

1. A process for development, which comprises:

using a non-magnetic toner having a circularity degree of more than 0.94 and having a falling amount, determined by a tester, of at least 10 g/5 minutes, feeding the above toner via a sub-roller onto a development roller disposed against a photosensitive drum, wherein rotating directions of the development roller and the sub-roller are prescribed in a downward direction at a portion where these rollers face each other, forming a thin layer of the toner on the development roller by a blade press-contacted with the development roller, and contacting the thin layer of the toner with a surface of the photosensitive drum on which an electric latent image is formed, to perform the development of the electrostatic latent image.

2. A process for devlopment according to claim 1 wherein rotating directions of the development roller and the photosensitive drum are prescribed in an upward direction at a portion where the development roller and the photosensive drum face each other.

3. A process for development according to claim 1 wherein the peripheral speed of the sub-roller is prescribed to be 1.05 to 3.1 times the peripheral speed of the development roller.

4. A process for development according to claim 1 wherein on the tip of the blade, a silicone rubber-made pressing member is provided.

5. A process for development according to claim 4 wherein the silicone rubber has a hardness A (JIS K 6301) of 75 to 85 degrees.

6. A non-magnetic toner which is used in a non-magnetic contacting one-component developing system in which the rotating directions of a development roller and a sub-roller for supplying the toner to the development roller are prescribed in a downward direction at a portion in which both rollers face each other, and which toner has a circularity degree of greater than 0.94, and an amount of falling, measured by a tester, is at least 10 g/5 minutes.

* * * * *